US006619292B2

(12) United States Patent
Saitou

(10) Patent No.: US 6,619,292 B2
(45) Date of Patent: Sep. 16, 2003

(54) TIP PAPER PREDRYING APPARATUS

(75) Inventor: Masayoshi Saitou, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 151 days.

(21) Appl. No.: 09/793,773

(22) Filed: Feb. 27, 2001

(65) Prior Publication Data

US 2001/0006067 A1 Jul. 5, 2001

Related U.S. Application Data

(63) Continuation of application No. PCT/JP99/04618, filed on Aug. 26, 1999.

(30) Foreign Application Priority Data

Aug. 27, 1998 (JP) ..... 10-242216

(51) Int. Cl.[7] ..... A24C 5/26; A24C 5/24

(52) U.S. Cl. ..... 131/68; 131/69; 131/92; 131/67

(58) Field of Search ..... 131/68, 69, 88, 131/92, 58, 67, 60

(56) References Cited

U.S. PATENT DOCUMENTS

| | | | | |
|---|---|---|---|---|
| 3,127,497 A | * | 3/1964 | Taylor | 219/19 |
| 4,265,255 A | | 5/1981 | Helms | |
| 4,291,713 A | * | 9/1981 | Frank | 131/68 |
| 4,368,743 A | * | 1/1983 | Barbe et al. | 131/88 |
| 5,611,359 A | | 3/1997 | Ogura et al. | |
| 2001/0019482 A1 | * | 9/2001 | Kobayashi et al. | 362/510 |

FOREIGN PATENT DOCUMENTS

| | | |
|---|---|---|
| JP | A54143600 | 11/1979 |
| JP | A5268928 | 10/1991 |
| JP | A7265046 | 10/1995 |
| JP | A10314651 | 12/1998 |

* cited by examiner

*Primary Examiner*—Steven P. Griffin
*Assistant Examiner*—Dionne A. Walls
(74) *Attorney, Agent, or Firm*—Birch, Stewart, Kolasch & Birch, LLP

(57) ABSTRACT

A tip paper predrying apparatus attached to a filter attachment includes an infrared lamp unit (16) located in the middle of a transfer path for a tip paper (P). After paste is applied to one surface of the tip paper in a paste applicator section (2), the pasted surface of the tip paper is irradiated with infrared rays from the infrared lamp unit before the tip paper is cut into individual tip paper pieces in a cutter section (4), whereby the tip paper is predried without any special contact with a heat source.

13 Claims, 3 Drawing Sheets

TIP PAPER PREDRYING APPARATUS

This application is a Continuation of PCT International Application No. PCT/JP99/04618 filed on Aug. 26, 1999, which designated the United States, and on which priority is claimed under 35 U.S.C. §120, the entire contents of which are hereby incorporated by reference.

TECHNICAL FIELD

The present invention relates to a filter attachment of a filter cigarette manufacturing system, and more specifically, to a predrying apparatus provided in the filter attachment for moderately drying paste applied to a tip paper.

BACKGROUND ART

A filter attachment of a filter cigarette manufacturing system comprises a wrapping section for winding a piece of tip paper on a joining portion between a cigarette rod and a filter plug. For the supply of tip paper pieces to the wrapping section, the filter attachment comprises a paste applicator section for applying paste to one surface of a tip paper and a cutter section for cutting the pasted tip paper into tip paper pieces. The paste may overreach tip paper piece as the tip paper piece is wrapped, owing to an excessive moisture content of the paste applied to the tip paper or other reasons, to lower the external appearance quality of the filter cigarette. In order to eliminate such trouble and improve the initial adhesion of the paste, a predrying apparatus for drying the tip paper or the paste applied thereto is provided between the paste applicator section and the cutter section.

For example, a predrying apparatus is known, which is designed to heat an unpasted tip paper in advance by means of a heater that is embedded in a tip paper transfer roller. With this apparatus adapted to heat the tip paper before the application of paste, it is difficult to adjust the degree of dryness of the paste applied to the tip paper. Thus, the paste can be predried unsatisfactorily, so that it may overreach the tip paper piece. Conversely, the paste can be excessively dried, thereby lowering its adhesion to cause air leakage or warping of the tip paper piece.

Thus, there have been proposed apparatuses for predrying a tip paper- or paste thereon after the tip paper is applied with the paste. For example, these apparatuses include one which is of a type adapted to heat a tip paper by bringing a heater block in contact with a non-paste side surface of the tip paper or adapted to dry paste by directly blowing warm air onto a paste-side surface of a tip paper.

However, in the case of a predrying apparatus using a heater block to heat a non-paste side surface of the tip paper, it is still hard to appropriately adjust the degree of dryness of the paste on the tip paper. Since the tip paper applied with the hydrous paste is lowered in fiber strength, if an undesired force act between the heater block and the tip paper in contact therewith, the tip paper may be deformed. If the tip paper is deformed, a tip paper piece cannot be satisfactorily wound on a joining portion between a cigarette rod and a filter plug, and hence the external appearance of a cigarette may be ruined. Furthermore, in order to operate a cigarette manufacturing machine at high speed to increase the cigarette manufacturing speed, it is necessary to increase the tip paper transfer speed in the predrying apparatus. However, the frequency of occurrence of deformation of the tip paper, attributable to the contact between the tip paper and the heater block in the predrying process, generally increases as the tip paper transfer speed increases. It is difficult, therefore, to operate the predrying apparatus provided with a heater block at high speed to fit the high-speed operation of the cigarette manufacturing machine.

In the case of the predrying apparatus adapted to blow warm air, there is a small possibility of the blown warm air producing a force to deform the tip paper since the air serving as a heat transfer medium is highly compressible. In other words, there is a low possibility of the tip paper being deformed as it is predried. Since the warm air is blown on the paste side surface, the degree of dryness of the paste on the tip paper can be adjusted more satisfactorily than in the case where the non-paste side surface is heated. On the other hand, the predrying apparatus of this type typically comprises a hood located right over paper guides which define a tip-paper transfer face and a blower connected through a blower hose to an air inlet port in the hood. This predrying apparatus is designed to supply electric power to a heating wire mounted as a heat source in the hood, thereby heating air fed from the blower. The resulting warm air is blown from a lower opening of the hood onto the paste-side surface of the tip paper transferred along the paper guides. This predrying apparatus has a complicated construction as explained above and requires a wide installation space. Moreover, the warm air blown off from the hood may thermally influence the component parts of the filter attachment and the cigarette manufacturing machine that are arranged around the predrying apparatus. Isolating these peripheral component parts from the warm air requires large-scale incidental equipment and constitutes a hindrance to the simplification or compactification of the construction of the predrying apparatus.

DISCLOSURE OF THE INVENTION

An object of the present invention is to provide a tip paper predrying apparatus capable of predrying paste applied to a tip paper without deforming the tip paper and of being constructed relatively easily and compactly.

In order to achieve the object, according to the present invention, there is provided a tip paper predrying apparatus for use in a filter attachment that includes a paste applicator section for applying paste to one surface of an elongate tip paper delivered from a roll, a cutter section for cutting the pasted tip paper into tip paper pieces, and a wrapping section for wrapping a tip paper piece around a joining portion between a cigarette rod and a filter plug.

The tip paper predrying apparatus of the present invention comprises a transfer section having a transfer path extending between the paste applicator section and the cutter section, and a heat radiation section including at least one heat radiator, disposed opposite the transfer path at a distance from the tip paper transferred along the transfer path from the paste applicator section, for radiating heat rays toward a paste-side surface of the transferred tip paper.

According to the predrying apparatus of the present invention, the paste-side surface or pasted surface of the tip paper is irradiated with heat rays while the pasted tip paper is transferred from the paste applicator section to the cutter section. The paste on the tip paper is heated to be predried by means of the heat rays. In a conventional predrying apparatus using a heater block as a heat source, the tip paper must be brought into contact with the heat source in order to conduct heat from the heat source directly to the tip paper. According to the present invention, the paste applied to the tip paper can be predried in a condition that the heat radiator serving as a heat source is out of contact with the tip paper. Therefore, even a tip paper of which the fiber strength is lowered by the application of the paste can be predried, without any possibility or with a substantially lowered possibility of the tip paper being deformed. Thus, according to this invention, there is no contact or friction between the tip paper and the heat source, so that the tip paper may be predried without being deformed even if the tip paper transfer speed is increased. Thus, the predrying apparatus of this invention is conducive to a speed-up of the operation of filter attachments that is required for a high-speed operation of cigarette manufacturing machines. As compared with the conventional predrying apparatus using warm air, the apparatus of this invention has a simpler construction and requires no wide installation space. In the case where warm air is used, the warm air may exert thermal influences upon peripheral elements. In order to eliminate or reduce the thermal influences, the peripheral elements must be isolated from air flows serving as heat transfer medium. Since the direction of propagation of the air flows changes freely, isolating the air flows from the peripheral elements requires large-scale incidental equipment. According to this invention in which the heat rays that propagate rectilinearly are employed instead of air flows, the heat rays can be intercepted on this side of the peripheral elements as required, whereby the thermal influences of the heat rays upon the peripheral elements can be removed with ease.

Preferably, in the present invention, the at least one heat radiator of the heat radiation section extends across the transfer path and radiates heat rays to the paste-side surface of the transferred tip paper throughout the width region of the paste-side surface.

According to this preferred mode, the entire paste-side surface of the tip paper can be heated, so that the paste on the tip paper can be predried satisfactorily.

Preferably, the heat radiation section includes a plurality of heat radiators arranged along the transfer path.

With this preferred mode, the tip paper can be moderately predried with use of a required number of heat radiators in consideration of the heat radiation doses of the individual heat radiators and the dose of heat rays absorbed by the paste (especially, moisture content in the paste) applied to the tip paper. Since the heat radiation section is composed of a plurality of heat radiators, the necessary heat-radiation capability of each individual heat radiator can be lowered, whereby the heat radiators can be miniaturized. Thus, the heat radiation section can be made compact as a whole.

Preferably, the heat radiator is an infrared radiator for radiating infrared rays.

More preferably, the infrared radiator includes a lamp housing and at least one infrared lamp attached thereto. The lamp housing has an infrared-ray transmitting surface, such as a glass surface or open surface, opposed to the paste-side surface of the transferred tip paper. The infrared lamp irradiates infrared rays through the infrared-ray transmitting surface of the lamp housing.

According to these preferred modes, the paste applied to the tip paper, especially, moisture content in the paste, can be satisfactorily heated by means of the infrared rays emitted from the infrared radiator, whereby the paste on the tip paper can be predried properly.

Preferably, the tip paper predrying apparatus of this invention further comprises a thermal insulating section including at least one insulating board for intercepting the heat rays from the heat radiator.

With this preferred mode, thermal influences of the heat rays from the heat radiator upon the component parts of the filter attachment and a cigarette manufacturing machine that are arranged around the predrying apparatus can be eliminated by intercepting the heat rays by means of the insulating board, a simple structure.

Further preferably, the thermal insulating section includes a first insulating board, located on the side opposite from the heat radiation section with respect to the transferred tip paper and opposed to the heat radiation section, and second and third insulating boards located on the upstream and downstream sides, respectively, of the heat radiation section in the tip-paper transfer direction. The second and third insulating boards are formed with slits through which the transferred tip paper is passed.

With this preferred mode, the heat radiation section is surrounded by the insulating boards and isolated from the peripheral elements. The heat rays from the heat radiation section are intercepted on this side of the peripheral elements, so that they never exert any thermal influences upon the peripheral elements.

Preferably, in the present invention, at least one of the heat radiation section and the transfer section is relatively movable toward and away from the other section, and the predrying apparatus further comprises an actuator for moving the at least one section toward and away from the other section.

With this preferred mode, the heat radiation section can be relatively moved toward and away from the paste-side surface of the tip paper, and the degree of heating of the tip paper by means of the heat rays can be adjusted by making this relative movement.

More preferably, the predrying apparatus further comprises a controller for controlling the drive of the actuator in accordance with the operating state of the predrying apparatus.

According to this preferred mode, the predrying by means of the heat rays can be made efficiently by, e.g., bringing the paste-side surface of the tip paper and the heat radiation section close to each other when the predrying apparatus is operating. When the predrying apparatus is nonoperating, on the other hand, the paste-side surface of the tip paper and the heat radiation section can be separated from each other, so that scorching of the tip paper and undesired contact between the tip paper and the heat radiation section may be prevented securely.

Alternatively, the predrying apparatus comprises a controller for controlling the drive of the heat radiator in accordance with the operating state of the predrying apparatus.

With this preferred mode, for example, the heat radiator is actuated for heat radiation to make the predrying executable when the predrying apparatus is operating. When the predrying apparatus is nonoperating, on the other hand, the heat-radiating operation of the heat radiator is prohibited to render the predrying inexecutable.

Preferably, the predrying apparatus comprises a detector, located on the downstream side of the heat radiation section in the tip-paper transfer direction, for outputting a detection signal indicative of the predried degree of the paste on the predried tip paper, and a controller for controlling the drive of at least one of the actuator and the heat radiator in accordance with the detection signal.

According to this preferred mode, the distance of separation between the paste-side surface of the tip paper and the heat radiation section and hence the degree of heat radiation from the heat radiator can be adjusted in accordance with the detected degree of dryness of the paste on the predried tip paper, whereby a proper predrying can be achieved.

BEST MODE FOR CARRYING OUT THE INVENTION

Figure 1:
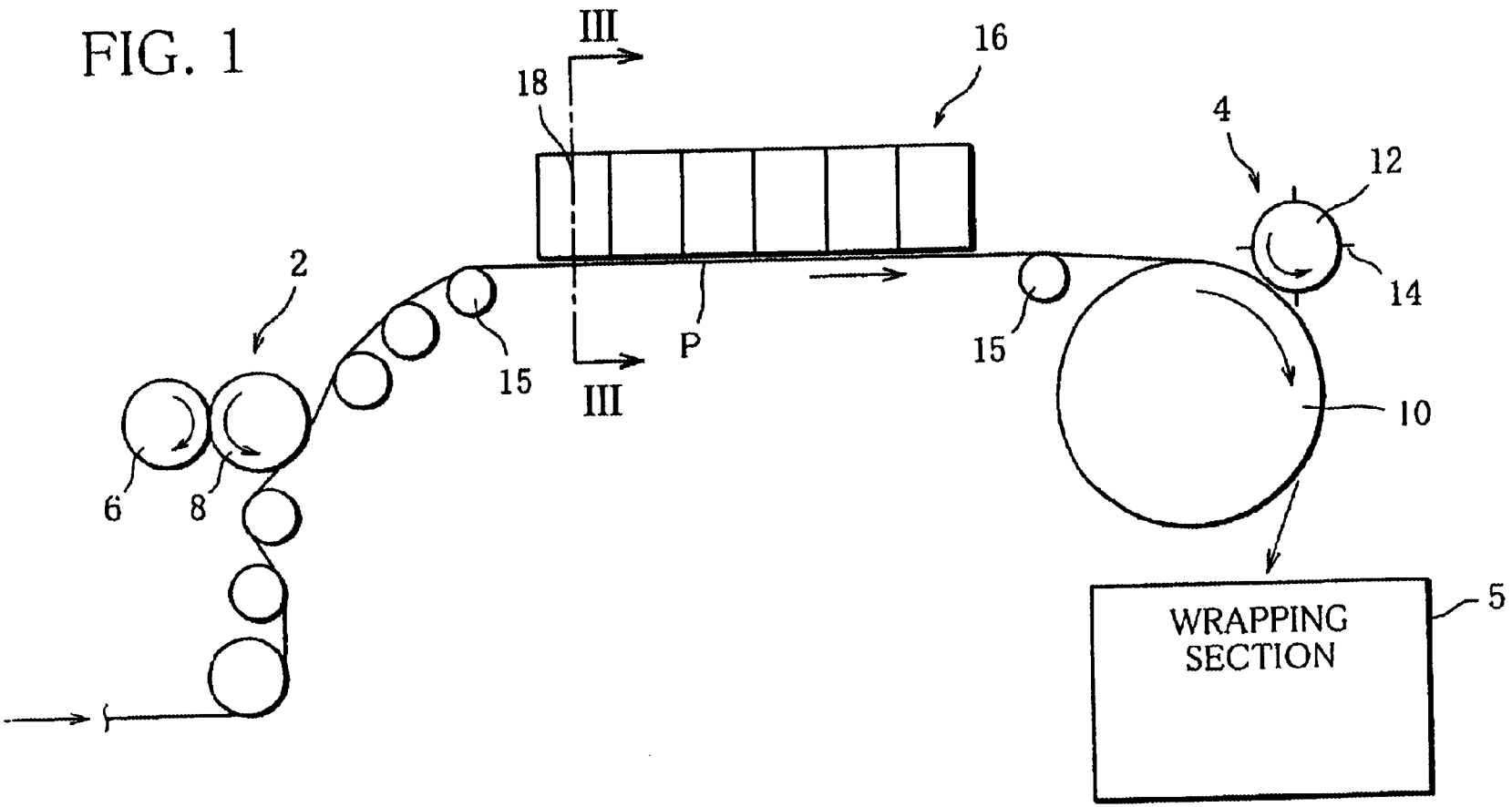
FIG. 1 is a schematic view showing a predrying apparatus according to one embodiment of the present invention.

As shown in FIG. 1, a filter attachment provided with a tip paper predrying apparatus according to one embodiment of the present invention includes a paste applicator section 2 for applying paste to a tip paper P. The paste applicator section 2 includes a glue roller 6 and a transmission roller 8 that is in rolling contact therewith. The tip paper P delivered from a roller (not shown) is brought into contact with that portion of the outer peripheral surface of the transmission roller 8 which is situated remote from the glue roller. In the paste applicator section 2, the paste supplied to the outer peripheral surface of the glue roller 6 is transferred with a given layer thickness from the glue roller 6 to the outer peripheral surface of the transmission roller 8 and further from the transmission roller 6 to one surface (upper surface in this case) of the tip paper P, whereby the paste is uniformly applied to the upper surface of the tip paper P.

A cutter section 4 for cutting the pasted tip paper into tip paper pieces is provided on the downstream side of the paste applicator section 2. The cutter section 4 is provided with a drum 10 for holding the tip paper P on its outer peripheral surface by suction and a bladed drum 12 that is located close to the drum 10 and can rotate in synchronism with the rotation of the drum. In the cutter section 4, the tip paper P, held on the outer peripheral surface of the drum 10 by suction, is cut into tip paper pieces of a given length by means of cork knives 14.

A wrapping section 5 for attaching a filter plug (not shown) to each cigarette rod (not shown) is provided on the downstream side of the cutter section 4. In the wrapping section 5, cigarette rods that are supplied one after another from a cigarette manufacturing machine (not shown) are arranged in pairs, axially aligned with and spaced from each other, and filter plugs of double length are supplied one after another from a filter manufacturing machine (not shown), each filter plug being interposed between the paired cigarette rods. Then, these two cigarette rods are joined individually to the opposite end faces of the filter plug, and a tip paper piece is wound on a joining portion between them. In the later stage of the filter attachment, the joined combination of the cigarette rods and the filter plug is cut in the center of the filter plug, to be divided into two filter cigarettes.

Since the respective configurations of the paste applicator section 2, cutter section 4, and wrapping section 5 associated with the aforesaid functions are conventionally known, a further description of them is omitted.

The predrying apparatus of this embodiment includes a transfer section having a transfer path extending between the paste applicator section 2 and the cutter section 4. The transfer path is defined by a plurality of guide rollers including a pair of guide rollers 15 that are located individually at the inlet and outlet of the predrying apparatus. The tip paper P pasted in the paste applicator section 2 is transferred along the transfer path from the paste applicator section 2 to the cutter section 4.

The predrying apparatus comprises a heat radiation section 16, which is located opposite the transfer path at a distance from the pasted tip paper P transferred along the transfer path. The heat radiation section 16 includes at least one heat radiator that emits heat rays toward a paste-side surface or pasted surface of the tip paper P.

Figure 2:
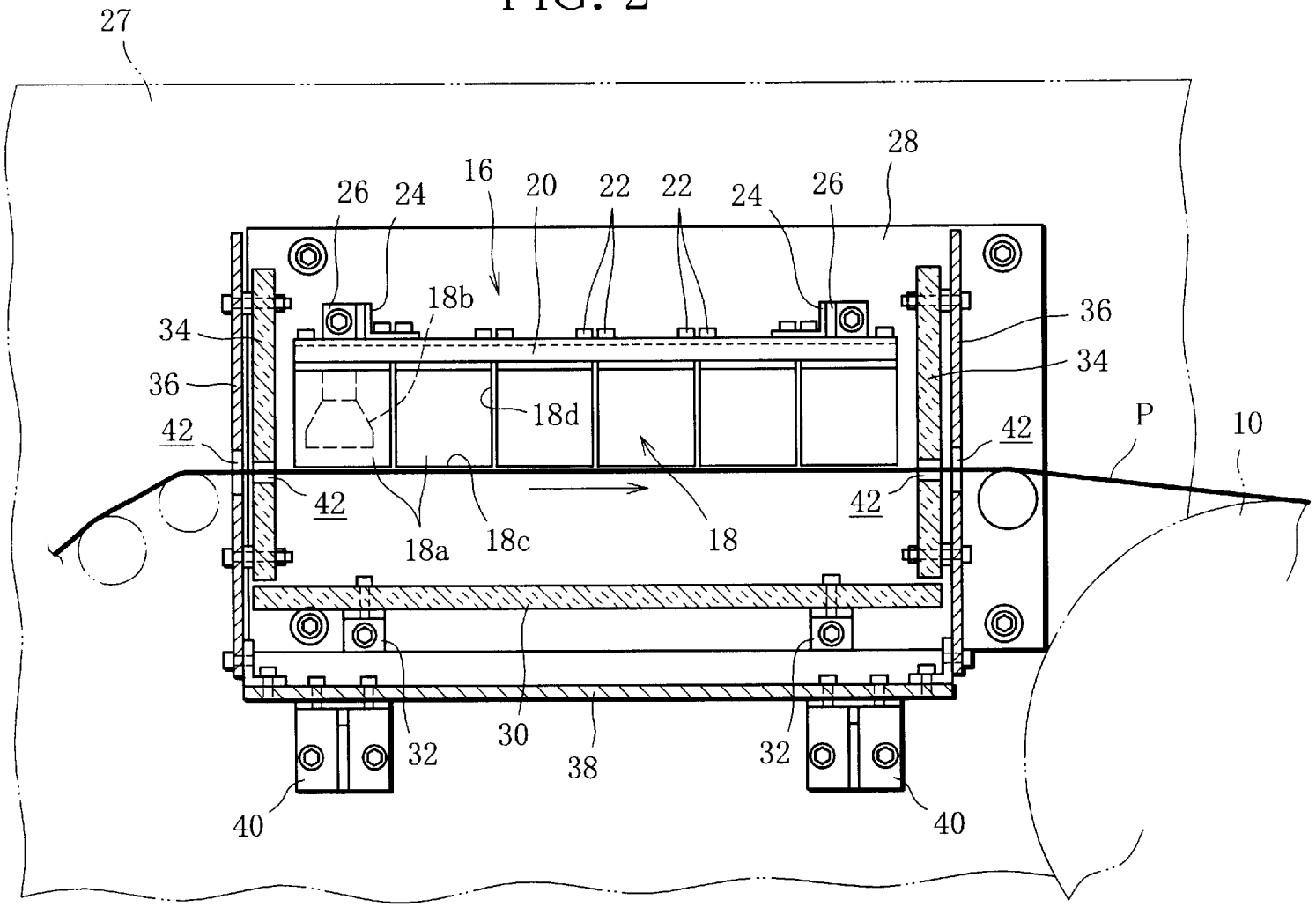
FIG. 2 is a fragmentary enlarged side view, partially in section, of the heating section housed in the surrounding structure, showing in detail the infrared lamp unit shown in FIG. 1.

The heat radiation section 16 of this embodiment is composed of an infrared lamp unit 16, which is located close to the upper surface (paste-side surface) of the pasted tip paper P that is transferred along the transfer path. As shown in FIGS. 1 and 2, the infrared lamp unit 16 is formed of a plurality of (e.g., six) lamp assemblies (heat radiators) 18. These lamp assemblies 18 are arranged along the transfer path and form a lamp assembly array. Each lamp assembly 18 includes a lamp housing 18*a* and one or more (e.g., three) infrared lamps 18*b* received therein.

Figure 3:
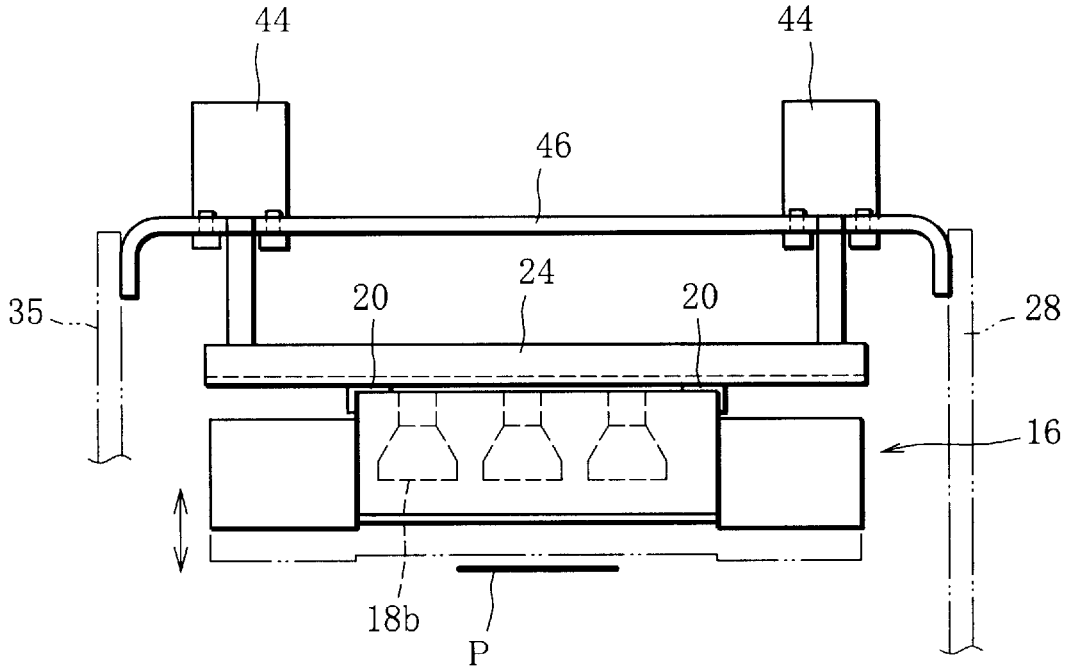
FIG. 3 is a fragmentary schematic end view, as viewed in the direction of around III—III of FIG. 1, showing a lamp unit lift mechanism provided in the predrying apparatus shown in FIG. 1.

As shown in FIG. 3, each lamp housing 18*a* extends across the tip-paper transfer path and projects long beyond the opposite sides of the tip paper P. Further, the lamp housing 18*a* has an infrared-ray transmitting surface, e.g., glass surface 18*c*, on its distal end, and if necessary, an infrared-ray reflecting member is attached to its inner surface 18*d*. The infrared lamps 18*b* serve to apply infrared rays to the tip paper P running on the transfer path, throughout the width region of tip paper, through the distal glass surface 18*c*.

Referring to FIGS. 2 and 3, the six lamp assemblies 18 that constitute the infrared lamp unit 16 are fixed at their upper surfaces to a pair of frame members 20 and are coupled to one another by means of the frame members 20. More specifically, the paired frame members 20 are arranged parallel to each other at a given space across the transfer path, and the lamp assemblies 18 are fixed to the frame members 20 by means of hexagon socket head bolts 22 that penetrate the frame members 20 and the respective upper walls of the lamp housings 18*a* and nuts (not shown) screwed on the bolts. Each lamp assembly 18 is fastened at four points by means of the bolts 22, two points for each frame member 20. FIG. 2 shows only one of the frame members 20 and its corresponding bolts 22.

Cross members 24 are stretched individually between the respective uppermost-stream end portions of the two frame members 20 and between their lowermost-stream end portions with respect to the tip-paper transfer direction. The opposite end portions of each cross member 24 are connected to the paired frame members 20, individually. In other words, the paired frame members 20 are coupled to each other by means of the cross members 24. The cross members 24 and the frame members 20 are connected by means of the bolts 22 and the nuts, and the bolts 22 for this connection penetrate the cross members 24.

Further, both the front and rear cross members 24 are fastened to brackets 26, individually, and the infrared lamp unit 16 is mounted on a base 27 of the filter attachment by means of the brackets 26. More specifically, base wall 28 is mounted along the outer surface of the base 27, and both the brackets 26 are fastened to the base wall 28. The base wall 28 extends at right angles to the tip-paper transfer path (in the height direction of the predrying apparatus) on one side of the tip paper P with respect to the direction across the transfer path. As illustrated, the base wall 28 is fastened to the base 27 at a plurality of spots.

The predrying apparatus of this embodiment is provided with a thermal insulating section including a plurality of insulating boards for intercepting infrared rays emitted from the infrared lamps 18*b*. The insulating boards are arranged between the infrared lamp unit 16 and the other components of the filter attachment than the predrying apparatus, surround the infrared lamp unit 16, and serve to intercept the infrared rays this side of the filter attachment components, thereby eliminating thermal influences of the infrared rays upon the components.

More specifically, the base wall 28 serves both as a base on which the infrared lamp unit 16 is fixed and as a mounting base for a first insulating board 30. Thus, the first insulating board 30 is located opposite the lower surface of the tip paper P and mounted on the base wall 28 by means of two brackets 32, as illustrated.

Second and third insulating boards 34 are located opposite each other near the front and rear portions of the infrared lamp unit 16 in the tip-paper transfer direction. These insulating boards 34 are attached to front and rear protective walls 36, individually. These front and rear protective walls 36 are mounted upright on the opposite end portions of a base plate 38, respectively. The base plate 38 is located under the first insulating board 30 and fixed to the base 27 by means of two brackets 40, as illustrated.

Further, a fourth insulating board (not shown) is located on that side of the infrared lamp unit 16 which is remote from the base wall 28. More specifically, a protective wall 35 (FIG. 3) is mounted upright on one side edge portion of the base plate 38 so as to face the base wall 28, the other side edge portion of which is mounted on the base wall 28, and the fourth insulating board is attached to the inside of the protective wall 35. If necessary, a fifth insulating board (not shown) is attached to the inside of the base wall 28.

In FIG. 2, the insulating boards 30 and 34, protective walls 36, and base plate 38 are shown in section along the center line of the transfer path. The insulating boards 34 and the protective walls 36 are provided with slits 42 through which the tip paper P is passed.

As the tip paper P is transferred in the aforesaid manner during the operation of the filter attachment, infrared rays from the infrared lamps 18*b* are irradiated toward the pasted surface of the tip paper. Thus, the paste on the tip paper P is heated and subjected to a predrying process. The outputs, infrared radiation dose and other performances of the infrared lamps are adjusted optimally in accordance with data such as the running speed of the tip paper P, the properties of the applied paste, the initial adhesion of the paste required after the drying process.

As shown in FIG. 3, the predrying apparatus of this embodiment is arranged to move the infrared lamp unit 16 toward or away from the tip paper P by driving actuators comprised of, e.g., single-acting air cylinders 44. More specifically, a bridge member 46 is stretched between the base wall 28 and the protective wall 35, as illustrated, and cylinder bodies 44*a* of the air cylinders 44 are located on the bridge member 46. The respective distal end portions of piston rods 44*b* of the air cylinders 44 are connected individually to the opposite end portions of the cross members 24. As exemplarily shown in FIG. 4, compressed-air inlet ports of the respective cylinder bodies 44*a* of the actuators 44 formed of single-acting air cylinders are designed to be connectable to a compressed air source 52 through an air supply pipe line, which is provided with a corresponding one of air supply on-off solenoid valves of a solenoid valve unit 51, and can communicate with the atmosphere by means of an air discharge pipe line that is provided with an on-off solenoid valve for air discharge. These on-off solenoid valves are switched under the control of a controller 53.

Figure 4:
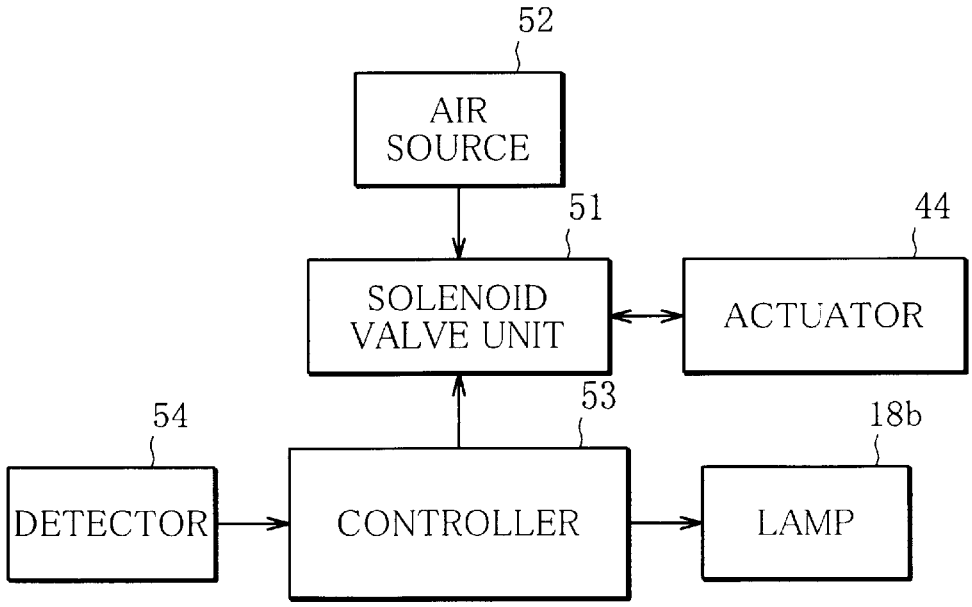
FIG. 4 is a schematic block diagram showing a control system for the lamp lift mechanism.

According to a lamp unit lift mechanism shown in FIGS. 3 and 4, if the on-off solenoid valves for air supply and air discharge are opened and closed, respectively, to drive the air cylinders 44, the piston rods 44*b* move individually into the cylinder bodies 44*a* so that their effective rod length is reduced as compressed air is supplied to cylinder chambers of the cylinder bodies 44*a,* whereby the lamp unit 16, along with the cross member 24, is pulled up to the illustrated retreat position. If both the solenoid valves for air supply and air discharge are closed to cancel the drive of the air cylinders 44, the piston rods are moved outward from the cylinder bodies by means of return springs in the cylinder bodies. As the piston rods extend in this manner, the lamp unit 16 lowers to a normal position indicated by two-dot chain line in the drawing, thereby approaching the tip paper P again. The lamp unit 16 can be smoothly guided in ascent and descent by means of linear guides (not shown) that are arranged along the opposite sides of the front and rear cross members 24, for example.

In stopping the operation of the filter attachment, the infrared lamp unit 16 is pulled up in the aforesaid manner to separate it from the tip paper P, whereby the tip paper P can be prevented from scorching or warping and sticking to the glass surface of the lamp unit 16. The transition from a state where the filter attachment is operated to a nonoperating state can be detected by watching signals indicating the start and stop of driving current supply to a tip-paper transfer motor (not shown) of the filter attachment by means of the controller 53, for example. If the halt of the operation of the filter attachment is detected by the controller 53 in accordance with the signal concerned, the aforesaid infrared-lamp-unit ascent control is carried out by the controller 53. If the start of the operation of the filter attachment is detected, the lamp-unit descent control is carried out by the controller 53.

According to the predrying apparatus of the embodiment described above, the paste predrying process can be carried out without touching the tip paper P during the operation of the filter attachment. The predrying apparatus, which is simple in construction, can be easily applied to an existing filter attachment.

The present invention is not limited to the foregoing embodiment and may be modified variously.

For example, the infrared lamp unit of the embodiment is designed to be moved up and down relative to the tip paper by the air cylinders 44 shown in FIG. 3. However, such a lift mechanism is not indispensable in this invention. More specifically, without the use of the infrared lamp unit lift mechanism, it is possible to prevent scorching of the tip paper attributable to infrared radiation while the operation of the filter attachment is stopped. For example, the infrared lamps 18*b* may be designed to be shut off under the control of the controller 53 when the interruption of the operation of the filter attachment is detected by the controller 53.

Further, the infrared lamp unit lift mechanism of the embodiment may be replaced with a lift mechanism having actuators for moving up and down the transfer section (pair of guide rollers 15) relative to the infrared lamp unit (heat radiation section). Furthermore, the lift mechanism of the embodiment may be modified so that the individual lamp assemblies 18 may be moved up and down independently of one another.

According to the embodiment described above, each of the six lamp assemblies 18 is comprised of the infrared lamps 18*b* that are arranged in the direction across the tip-paper transfer path, and these six lamp assemblies 18 are arranged adjacent to one another in the tip-paper transfer direction. In the present invention, however, the arrangement pattern and number of the infrared lamps in each lamp assembly and the total number and arrangement spaces of the lamp assemblies are not limited to those of the embodiment. For example, a required number of lamp assemblies may be arranged at given spaces in the tip-paper transfer direction.

The temperature or moisture content of the paste-side surface after the predrying process may be detected for feedback control of the outputs of the infrared lamps. In this case, one or more detectors (denoted by reference numeral 54 in FIG. 4), including a temperature sensor or a moisture content sensor for detecting the dryness of the tip paper P and the paste thereon, may be provided in the predrying apparatus on the downstream side of the infrared lamp unit (heat radiation section) 16 in the tip-paper transfer direction, so as to perform on-off-control the infrared lamps 18*b* or control the outputs of the infrared lamps 18*b* by means of the controller 53 in accordance with sensor signals, thereby adjusting the infrared intensity. The infrared lamp unit 16 may be moved up and down between the normal position and the retreat position as in the case of the foregoing embodiment, by the controller 53 in accordance with the sensor signals. Alternatively, the infrared lamp unit 16 may be located in any desired vertical position between the normal position and the retreat position by controlling the supply and discharge of the compressed air to and from the two cylinder chambers of the actuators 44 formed of double-acting air cylinders. By doing this, the dryness of the tip paper and the paste applied thereto can be optimized.

What is claimed is:

1. In a tip paper predrying apparatus for use in a filter attachment including a paste applicator section for applying paste to one surface of an elongate tip paper delivered from a roll, a cutter section for cutting the pasted tip paper into tip paper pieces, and a wrapping section for wrapping a tip paper piece around a joining portion between a cigarette rod and a filter plug, the tip paper predrying apparatus comprising:

a transfer section having a transfer path extending between the paste applicator section and the cutter section; and a heat radiation section housed in a surrounding structure, said heat radiation section including at least one heat radiator, disposed opposite said transfer path at a distance from the tip paper transferred along the transfer path from the paste applicator section, for radiating heat rays toward a paste-side surface of the transferred tip paper, wherein the surrounding structure includes front and rear protective walls formed with slits through which the tip paper passes.

2. A tip paper predrying apparatus according to claim 1, wherein said at least one heat radiator of said heat radiation section extends across said transfer path and radiates the heat rays to the paste-side surface of the transferred tip paper throughout a width region of the paste-side surface.

3. A tip paper predrying apparatus according to claim 1, wherein said heat radiation section includes a plurality of heat radiators arranged along said transfer path.

4. A tip paper predrying apparatus according to claim 1, wherein said heat radiator is an infrared radiator for radiating infrared rays.

5. A tip paper predrying apparatus according to claim 4, wherein said infrared radiator includes a lamp housing and at least one infrared lamp attached thereto, said lamp housing having an infrared-ray transmitting surface opposed to the paste-side surface of the transferred tip paper, said infrared lamp irradiating infrared rays as said heat rays through said infrared-ray transmitting surface of said lamp housing.

6. A tip paper predrying apparatus according to claim 1, further comprising:

a thermal insulating section including at least one insulating board for intercepting the heat rays from said heat radiator.

7. A tip paper predrying apparatus according to claim 6, wherein said thermal insulating section includes a first insulating board, located on a side opposite from said heat radiation section with respect to the transferred tip paper and opposed to said heat radiation section, and second and third insulating boards located on upstream and downstream sides, respectively, of said heat radiation section with respect to a tip-paper transfer direction, said second and third insulating boards being formed with slits through which the transferred tip paper is passed.

8. A tip paper predrying apparatus according to claim 1, wherein at least one of said heat radiation section and said transfer section is relatively movable toward and away from the other section, and said tip paper predrying apparatus further comprises an actuator for moving said at least one section toward and away from said other section.

9. A tip paper predrying apparatus according to claim 8, further comprising:

a controller for controlling a drive of said actuator in accordance with an operating state of said tip paper predrying apparatus.

10. A tip paper predrying apparatus according to claim 8, further comprising:

a detector, located on a downstream side of said heat radiation section with respect to a tip-paper transfer direction, for outputting a detection signal indicative of a predried degree of the paste on the predried tip paper; and a controller for controlling a drive of said actuator in accordance with said detection signal.

11. A tip paper predrying apparatus according to claim 1, further comprising:

a controller for controlling a drive of said heat radiator in accordance with an operating state of said tip paper predrying apparatus.

12. A tip of paper predrying apparatus according to claim 1, further comprising:

a detector, located on a downstream side of said heat radiation section with respect to a tip-paper transfer direction, for outputting a detection signal indicative of a predried degree of the paste on the predried tip paper; and a controller for controlling a drive of said heat radiator in accordance with said detection signal.

13. A tip paper predrying apparatus according to claim 1, said surrounding structure further comprising:

a base wall;

a protective wall mounted to face the base wall;

a bridge member stretching between the base wall and the protective wall;

a base plate, the front and rear protective walls being mounted on the base plate; and insulating boards being individually mounted on the base wall and the front and rear protective walls.

* * * * *